US011828107B1

(12) United States Patent
Warunek

(10) Patent No.: US 11,828,107 B1
(45) Date of Patent: Nov. 28, 2023

(54) LADDER PLATFORM SYSTEM

(71) Applicant: Robert P. Warunek, Clinton Township, MI (US)

(72) Inventor: Robert P. Warunek, Clinton Township, MI (US)

( * ) Notice: Subject to any disclaimer, the term of this patent is extended or adjusted under 35 U.S.C. 154(b) by 406 days.

(21) Appl. No.: 17/125,235

(22) Filed: Dec. 17, 2020

Related U.S. Application Data

(60) Provisional application No. 62/957,892, filed on Jan. 7, 2020.

(51) Int. Cl.
*E06C 7/16* (2006.01)
*E06C 7/48* (2006.01)
*E06C 1/12* (2006.01)

(52) U.S. Cl.
CPC ..... *E06C 7/16* (2013.01); *E06C 7/48* (2013.01); *E06C 1/12* (2013.01)

(58) Field of Classification Search
CPC ..... E06C 7/16; E06C 7/48; E06C 7/46; E06C 7/182; E06C 7/484; E06C 7/00; E06C 7/486; E06C 1/12; E06C 1/39; A01M 31/02
See application file for complete search history.

(56) References Cited

U.S. PATENT DOCUMENTS 2,881,028 A * 4/1959 Baird ..... E06C 7/16 182/120
3,734,236 A * 5/1973 Houtler ..... E06C 7/48 182/214
3,780,828 A * 12/1973 Overturf ..... E06C 7/48 182/111
4,159,045 A * 6/1979 Brooks ..... E06C 7/16 182/116
4,331,217 A * 5/1982 Stecklow ..... E06C 7/16 248/238
4,823,912 A * 4/1989 Gould ..... E06C 7/486 248/210
5,044,466 A * 9/1991 Jacobsmeyer, Jr. ..... E06C 7/16 182/119
5,117,941 A * 6/1992 Gruber ..... E06C 7/484 248/210
5,143,177 A * 9/1992 Smith ..... A01M 31/02 182/136
5,242,031 A * 9/1993 Ashley ..... E06C 7/48 182/129

(Continued)

*Primary Examiner* — Jessica L Laux
*Assistant Examiner* — Kathleen M. McFarland
(74) *Attorney, Agent, or Firm* — John F. Buckert; Buckert Patent & Trademark Law Firm PC

(57) ABSTRACT

A ladder platform system for attachment to an extension ladder is provided. The system includes a ladder platform assembly having a first tubular leg, a second tubular leg, a platform, and a tubular board support sleeve. The first tubular leg defines a first interior space that is sized and shaped to receive a top portion of a first ladder side rail therein. The second tubular leg defines a second interior space that is sized and shaped to receive a top portion of the second ladder side rail therein. The tubular board support sleeve is coupled to a bottom surface of the platform and is sized and shaped to receive a board therethrough. The system includes a first standoff member sized and shaped to receive the board therethrough, and a second standoff member sized and shaped to receive the board therethrough.

19 Claims, 8 Drawing Sheets

(56) References Cited

U.S. PATENT DOCUMENTS 5,460,240 A * 10/1995 Jones ..... E06C 7/16 182/116
D388,883 S * 1/1998 Thivierge ..... D25/68
6,158,551 A * 12/2000 Gray ..... E06C 7/48 248/292.12
6,189,652 B1 * 2/2001 Brown ..... E06C 7/16 248/238
6,336,520 B1 * 1/2002 Amacker ..... A01M 31/02 182/135
6,405,828 B1 * 6/2002 Redding ..... E06C 7/48 182/214
6,698,548 B1 * 3/2004 Verrill ..... E06C 7/14 248/238
6,945,359 B2 * 9/2005 Logiudice ..... E06C 7/48 182/214
8,136,632 B2 * 3/2012 Gabriel ..... E06C 7/165 182/116
8,201,661 B1 * 6/2012 O'Connell, Sr. ..... E06C 7/16 182/120
8,240,432 B2 * 8/2012 Call ..... A01M 31/02 182/135
8,251,180 B1 * 8/2012 Paige ..... E06C 7/48 182/214
8,844,675 B2 * 9/2014 Lampe ..... E06C 7/48 182/129
9,234,389 B2 * 1/2016 Umlor ..... E06C 7/48
9,284,778 B2 * 3/2016 Rittmann ..... E06C 7/48
9,540,875 B2 * 1/2017 Ellis ..... E06C 7/182
10,301,875 B2 * 5/2019 Stout ..... E06C 1/20
10,619,416 B1 * 4/2020 Snell ..... E06C 7/06
10,900,283 B1 * 1/2021 Sheets ..... E06C 7/16
2004/0055821 A1 * 3/2004 Kruse ..... E06C 7/482 182/107
2005/0023084 A1 * 2/2005 Lazarus ..... E06C 7/482 182/214
2005/0167197 A1 * 8/2005 Logiudice ..... E06C 7/48 182/107
2009/0255759 A1 * 10/2009 Barnes ..... E06C 7/482 182/204
2010/0006374 A1 * 1/2010 Gabriel ..... E06C 7/165 182/116
2010/0300808 A1 * 12/2010 Hale ..... A01M 31/02 182/187
2011/0000743 A1 * 1/2011 Call ..... A01M 31/02 182/115
2011/0095402 A1 * 4/2011 Park ..... E06C 7/482 257/649
2011/0247895 A1 * 10/2011 Smith ..... E06C 7/165 182/106
2012/0228059 A1 * 9/2012 Lampe ..... E06C 7/48 182/129
2012/0266436 A1 * 10/2012 Rittmann ..... E06C 7/14 29/428
2014/0318894 A1 * 10/2014 Chow ..... E06C 7/48 182/214
2015/0204140 A1 * 7/2015 Umlor ..... E06C 7/48 182/165
2018/0266178 A1 * 9/2018 Sapp ..... E06C 7/48
2018/0310547 A1 * 11/2018 McCharles ..... A01M 31/02
2019/0024457 A1 * 1/2019 Stout ..... E06C 7/48
2019/0048662 A1 * 2/2019 Beasse ..... E06C 7/505
2019/0218860 A1 * 7/2019 Seabold ..... E06C 7/46
2020/0260718 A1 * 8/2020 Robbins ..... A01M 31/02
2021/0062583 A1 * 3/2021 Greynolds ..... E06C 7/486
2021/0140237 A1 * 5/2021 Hagen ..... E06C 7/50

* cited by examiner

LADDER PLATFORM SYSTEM

CROSS-REFERENCE TO RELATED APPLICATIONS

This application claims priority to U.S. Provisional Patent Application No. 62/957,916 filed on Jan. 7, 2020, the entire contents of which are hereby incorporated by reference herein.

BACKGROUND

A problem with extension ladders placed against a building wall is that when a user climbs near a top of an extension ladder, the user is too close to wall to work comfortably. Further, there no convenient location to hold tools or products that the user is installing on the building.

The inventor herein has recognized a need for a ladder platform system that is coupled to a top of an extension ladder that provides sufficient space for a user to work comfortably on a building and which can hold tools or products that the user is installing on the building.

SUMMARY

A ladder platform assembly for attachment to an extension ladder in accordance with an exemplary embodiment is provided. The extension ladder has first and second ladder side rails and a ladder step coupled to and extending between the first and second ladder side rails. The ladder platform assembly includes a first tubular leg having a rectangular-shaped cross-sectional profile, first and second ends, and a first slot. The first slot extends through an inner wall of the first tubular leg and extends from the first end toward the second end thereof. The first tubular leg defines a first interior space between the first and second ends thereof that is sized and shaped to receive a top portion of the first ladder side rail therein. The first slot is sized and shaped to receive a portion of the ladder step therein. The ladder platform assembly further includes a second tubular leg having a rectangular-shaped cross-sectional profile, first and second ends, and a second slot. The second slot extends through an inner wall of the second tubular leg and extends from the first end toward the second end thereof. The second tubular leg defines a second interior space between the first and second ends thereof that is sized and shaped to receive a top portion of the second ladder side rail therein. The second slot is sized and shaped to receive another portion of the ladder step therein. The ladder platform assembly further includes a platform coupled to the second end of the first tubular leg and the second end of the second tubular leg such that the platform encloses the second end of the first tubular leg, and the platform further encloses the second end of the second tubular leg.

A ladder platform system for attachment to an extension ladder in accordance with another exemplary embodiment. The extension ladder having first and second ladder side rails and a ladder step coupled to and extending between the first and second ladder side rails. The ladder platform system includes a ladder platform assembly having a first tubular leg, a second tubular leg, a platform, and a tubular board support sleeve. The first tubular leg has a rectangular-shaped cross-sectional profile, first and second ends, and a first slot. The first slot extends through an inner wall of the first tubular leg and extends from the first end toward the second end thereof. The first tubular leg defines a first interior space between the first and second ends thereof that is sized and shaped to receive a top portion of the first ladder side rail therein. The first slot is sized and shaped to receive a portion of the ladder step therein. The second tubular leg has a rectangular-shaped cross-sectional profile, first and second ends, and a second slot. The second slot extends through an inner wall of the second tubular leg and extends from the first end toward the second end thereof. The second tubular leg defines a second interior space between the first and second ends thereof that is sized and shaped to receive a top portion of the second ladder side rail therein. The second slot is sized and shaped to receive another portion of the ladder step therein. The platform is coupled to the second end of the first tubular leg and the second end of the second tubular leg such that the platform encloses the second end of the first tubular leg, and the platform further encloses the second end of the second tubular leg. The tubular board support sleeve being coupled to a bottom surface of the platform and being sized and shaped to receive a board therethrough. The ladder platform system further includes a first standoff member sized and shaped to receive the board therethrough. The ladder platform system further includes a second standoff member sized and shaped to receive the board therethrough.

DETAILED DESCRIPTION

Figure 1:
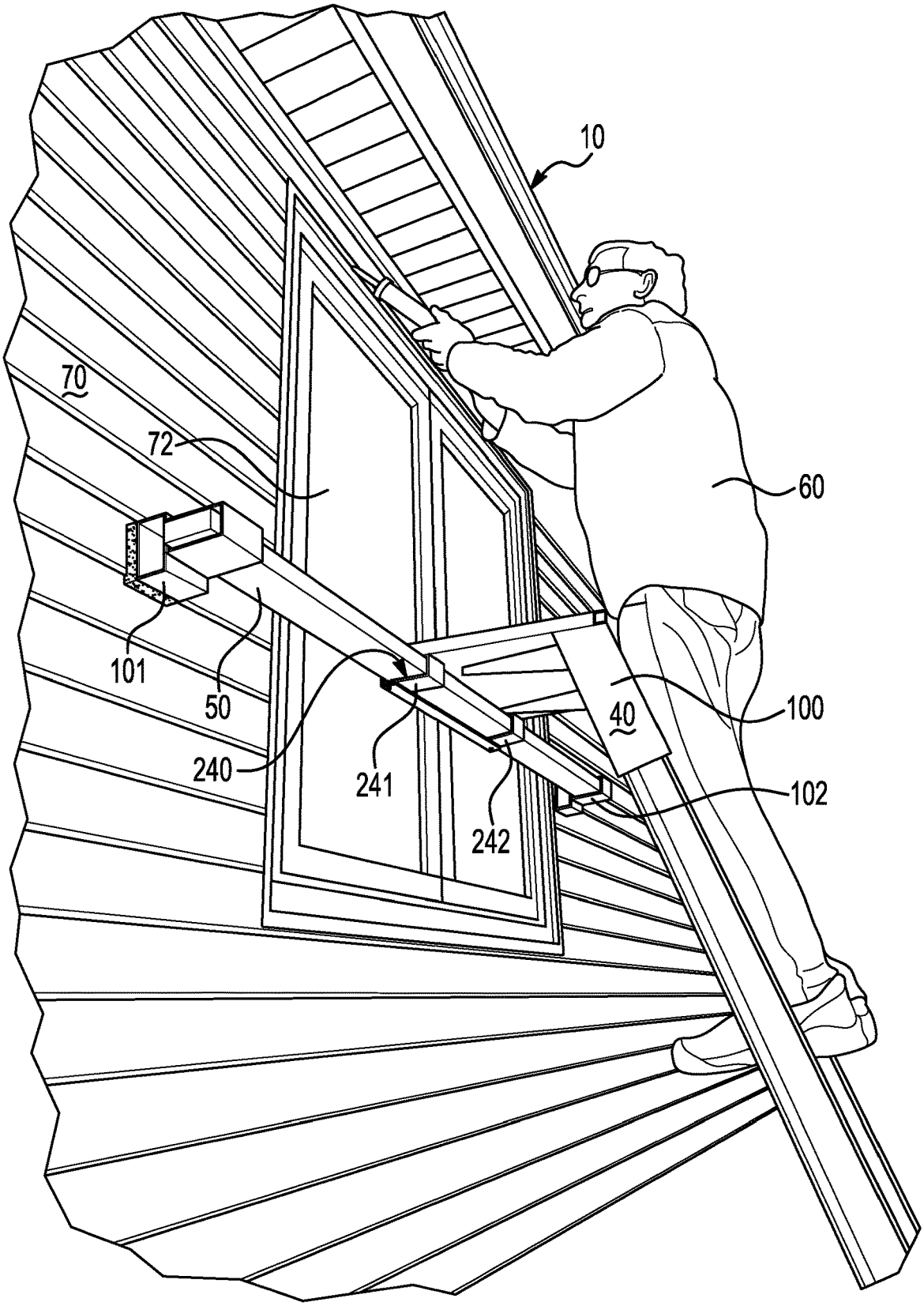
FIG. 1 is a schematic of an exterior of a building having an outer wall, a ladder, and a ladder platform system in accordance with an exemplary embodiment leaning against the outer wall.

Referring to FIGS. 1-15, a house 10, an extension ladder 30, a ladder platform system 40 in accordance with an exemplary embodiment, a board 50, and a window installer 60 are illustrated. The ladder platform system 40 is coupled to a top portion of the extension ladder 30 and leans against an outer wall 70 of the house 10.

The house 10 includes the outer wall 70 and a window 72 disposed in the outer wall 70.

Figure 2:
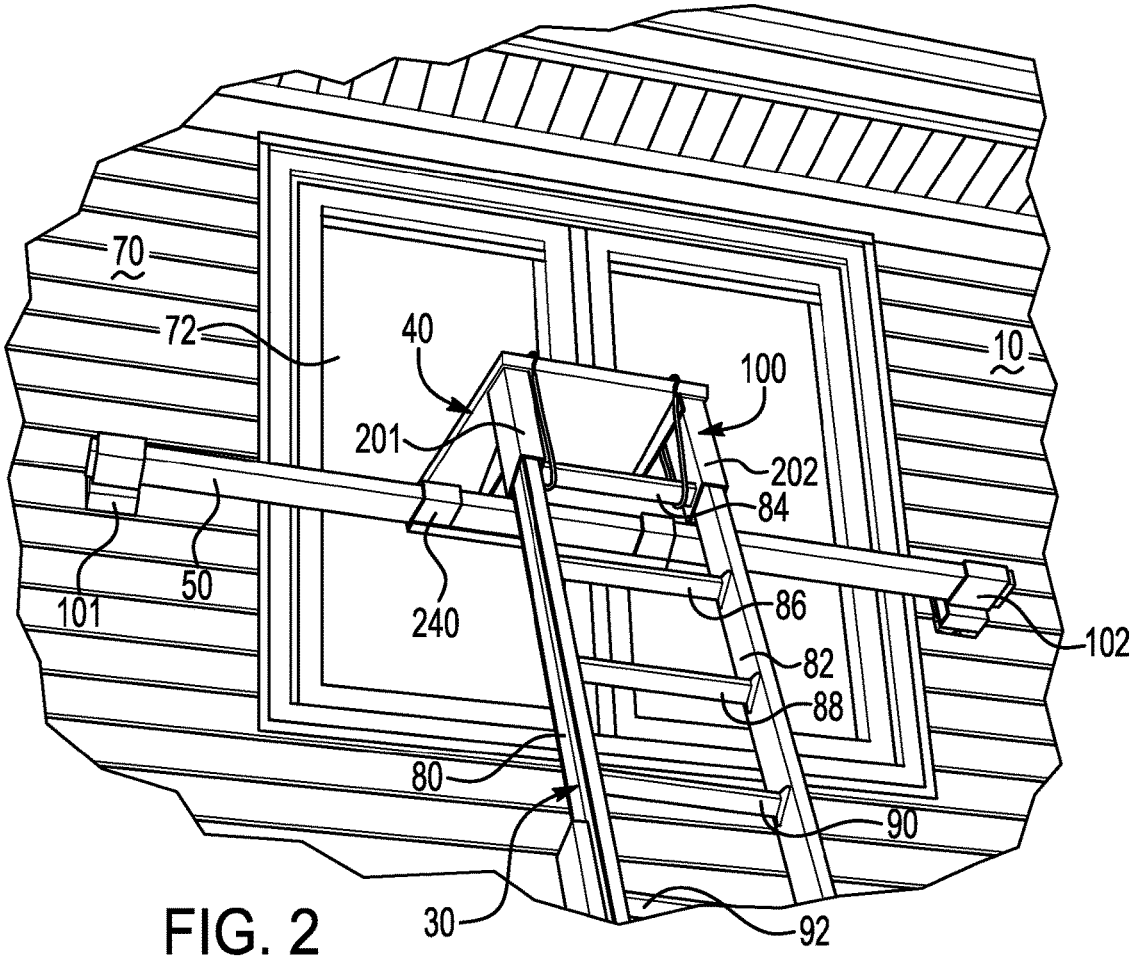
FIG. 2 is another schematic of the outer wall, the extension ladder, and the ladder platform system of FIG. 1.
Figure 3:
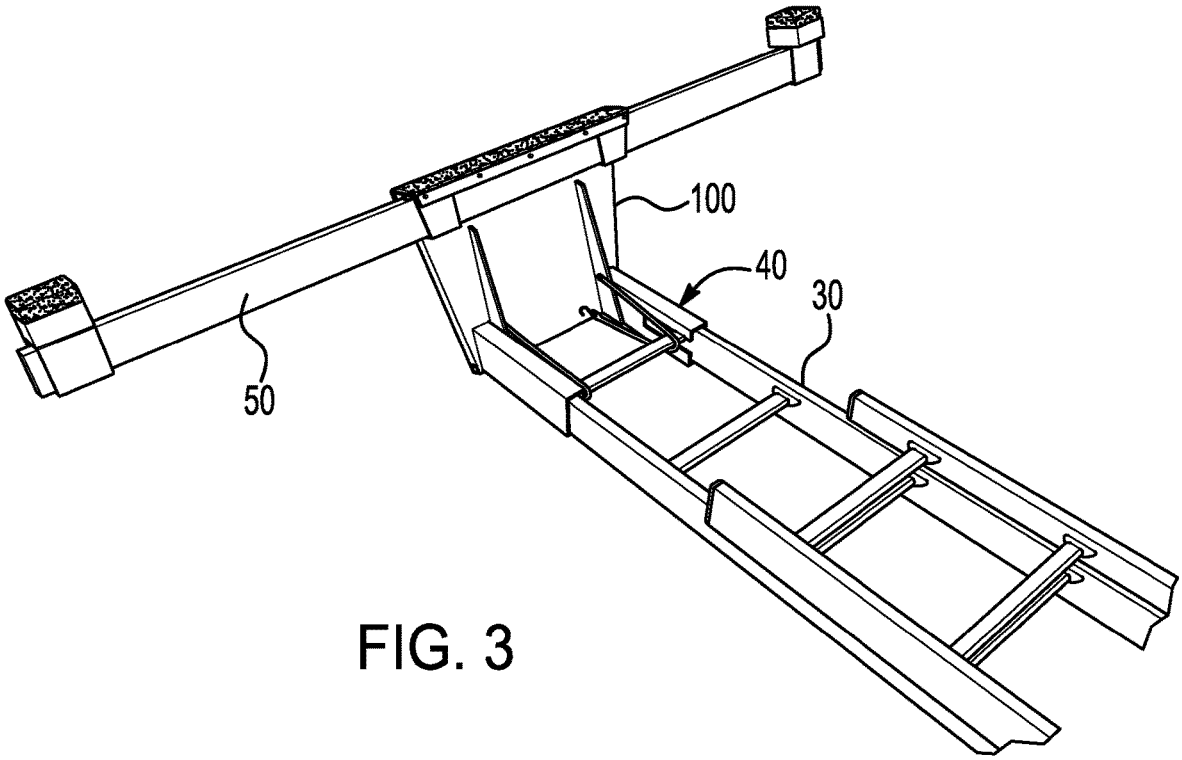
FIG. 3 is a schematic of a portion of the extension ladder, and the ladder platform system of FIG. 1.
Figure 4:
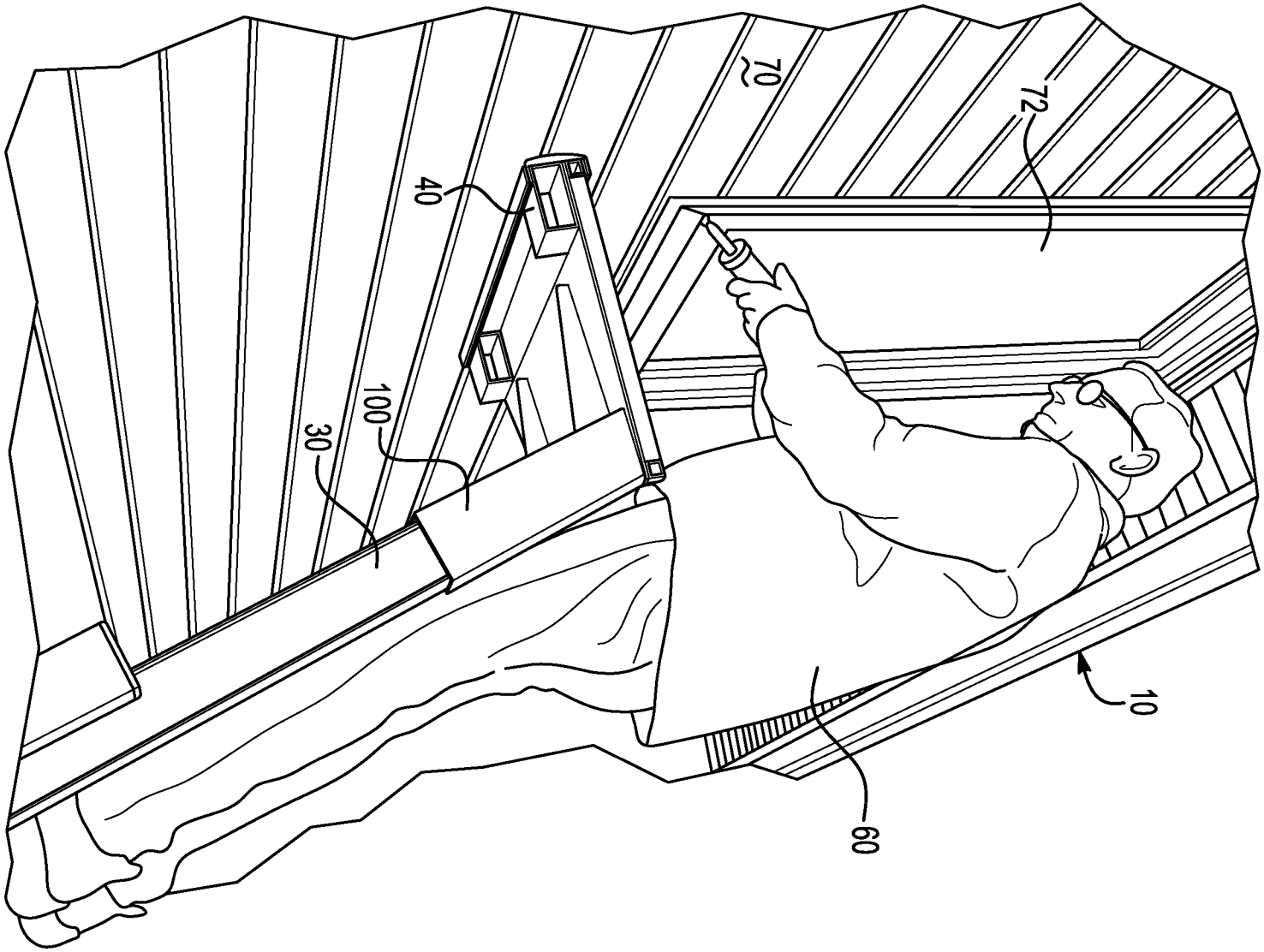
FIG. 4 is another schematic of the outer wall, the extension ladder, and the ladder platform system of FIG. 1.
Figure 5:
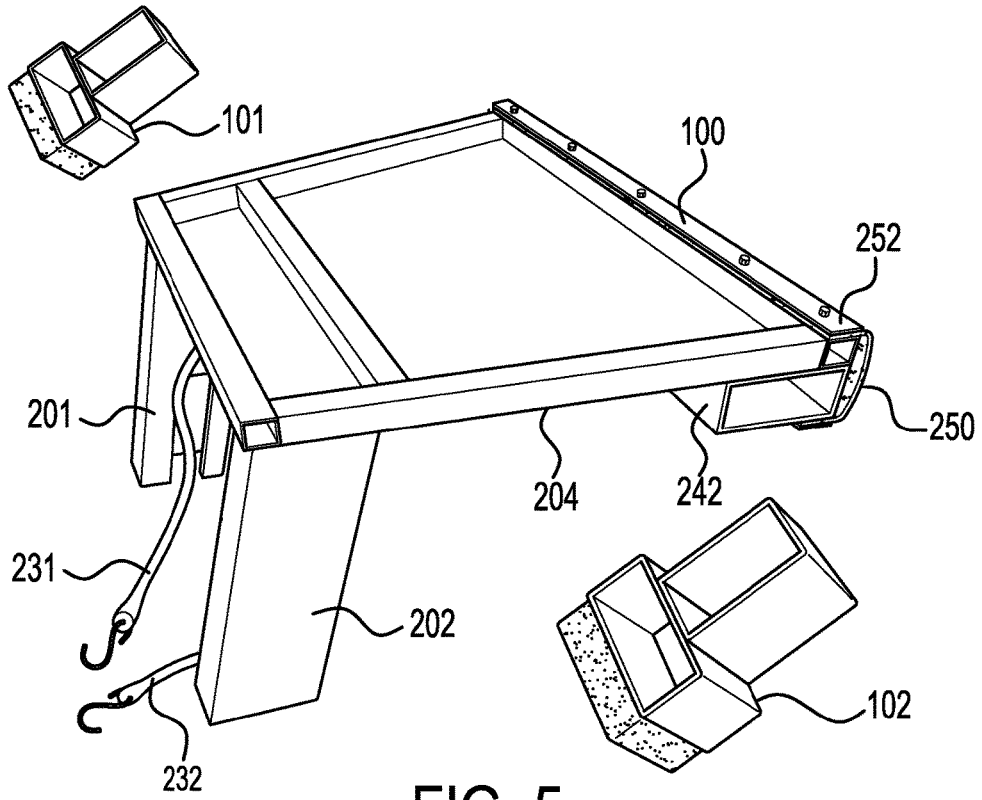
FIG. 5 is a schematic of the ladder platform system of FIG. 1.

Referring to FIG. 2, the extension ladder 30 includes a first ladder side rail 80, a second ladder side rail 82 and ladder steps 84, 86, 88, 90, 92. The ladder steps 84, 86, 88, 90, 92 are coupled to and between the first and second ladder side rails 80, 82.

Referring to FIGS. 1-10, the ladder platform system 40 is coupled to a top of the extension ladder 30 and provides sufficient space for a user to work comfortably on the house 10 and which can hold tools or products that the user is installing on the house 10. The ladder platform system 40 includes a ladder platform assembly 100, a first standoff member 101, and a second standoff member 102.

Referring to FIGS. 2-13, the ladder platform assembly 100 includes a first tubular leg 201, a second tubular leg 202, a platform 204, a first support plate 221 (shown in FIG. 8), a second support plate 222, a first strap member 231 (shown in FIG. 7), a second strap member 232, a first screw 235 (shown in FIG. 11), a second screw 236 (shown in FIG. 10), a tubular board support sleeve 240, a bumper member 250, and an attachment plate 252.

Figure 11:
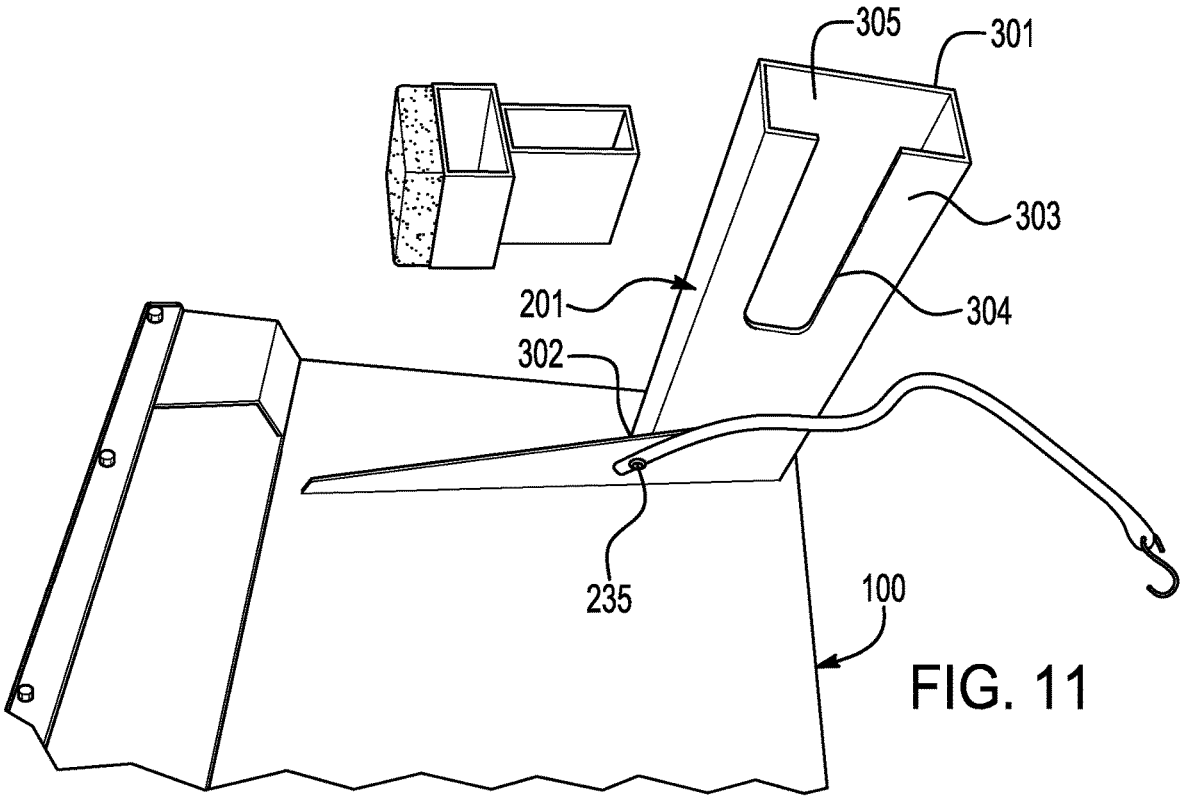
FIG. 11 is another enlarged bottom view of a portion of the ladder platform system of FIG. 5.

Referring to FIGS. 2 and 11, the first tubular leg 201 has a rectangular-shaped cross-sectional profile, first and second ends 301, 302, and a first slot 304. The first slot 304 extends through an inner wall 303 of the first tubular leg 201 and extending from the first end 301 toward the second end 302 thereof. The first tubular leg 201 defines a first interior space 305 between the first and second ends 301, 302 thereof that is sized and shaped to receive a top portion of the first ladder side rail 80 therein. The first slot 304 is sized and shaped to receive a portion of the ladder step 84 therein.

Figure 10:
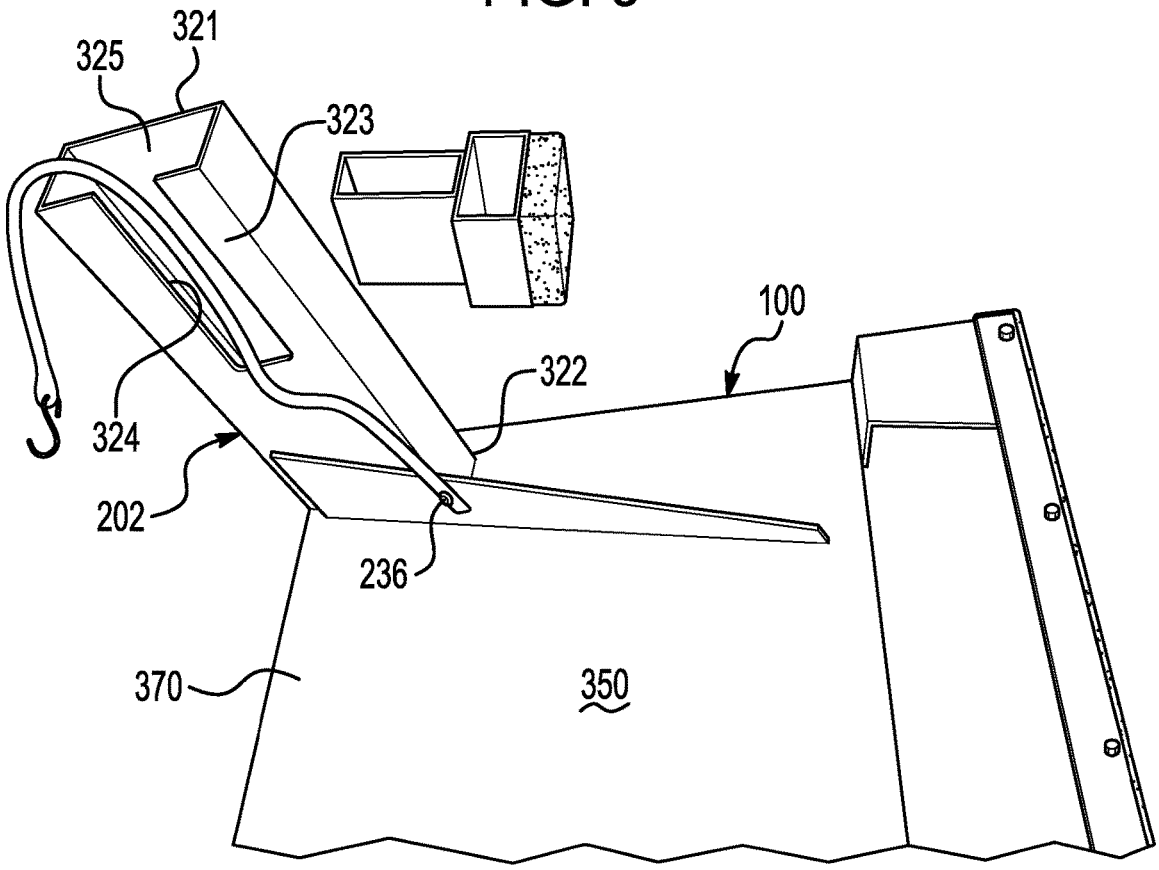
FIG. 10 is an enlarged bottom view of a portion of the ladder platform system of FIG. 5.

Referring to FIGS. 2 and 10, the second tubular leg 202 has a rectangular-shaped cross-sectional profile, first and second ends 321, 322, and a second slot 324. The second slot 324 extends through an inner wall 323 of the second tubular leg 202 and extends from the first end 321 toward the second end 322 thereof, The second tubular leg 202 defines a second interior space 325 between the first and second ends 321, 322 thereof that is sized and shaped to receive a top portion of the second ladder side rail 82 therein. The second slot 324 is sized and shaped to receive another portion of the ladder step 84 therein.

Figure 6:
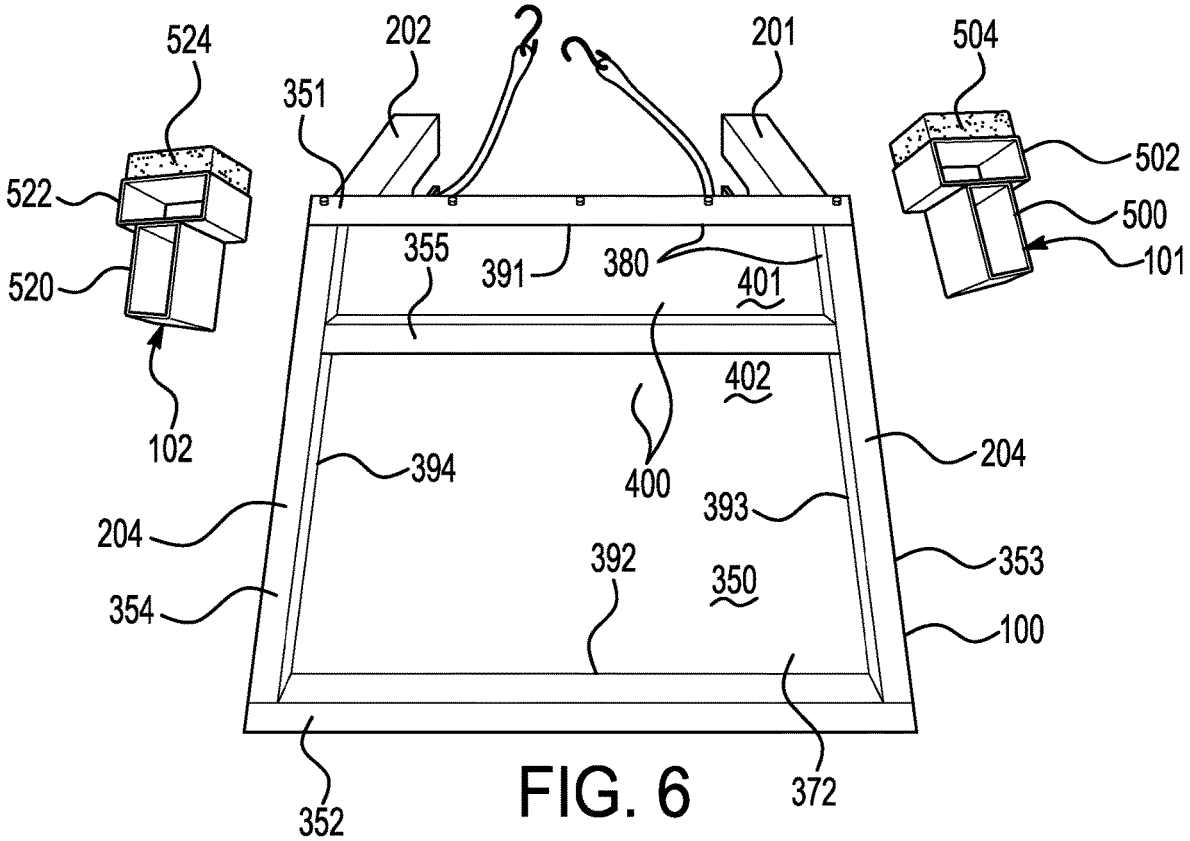
FIG. 6 is a top view of the ladder platform system of FIG. 5.

Referring to FIGS. 6, 10 and 11, the platform 204 is coupled to the second end 302 of the first tubular leg 201 and the second end 322 of the second tubular leg 202 such that the platform 204 encloses the second end 302 of the first tubular leg 201, and the platform 204 further encloses the second end 322 of the second tubular leg 202. The platform 204 extends in a first direction from the first and second tubular legs 201, 202.

Figure 12:
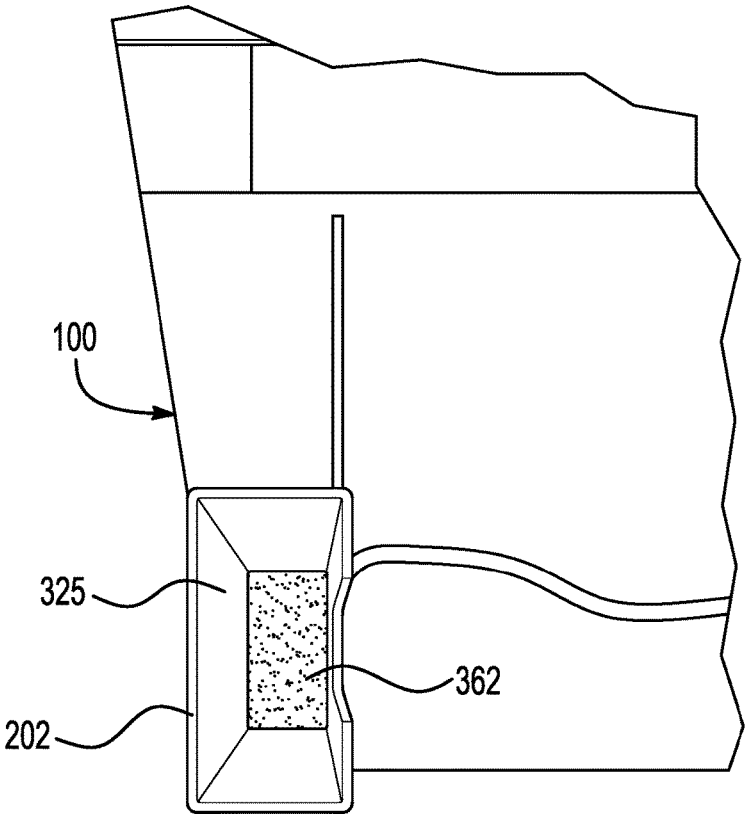
FIG. 12 is another enlarged bottom view of a portion of the ladder platform system of FIG. 5.
Figure 13:
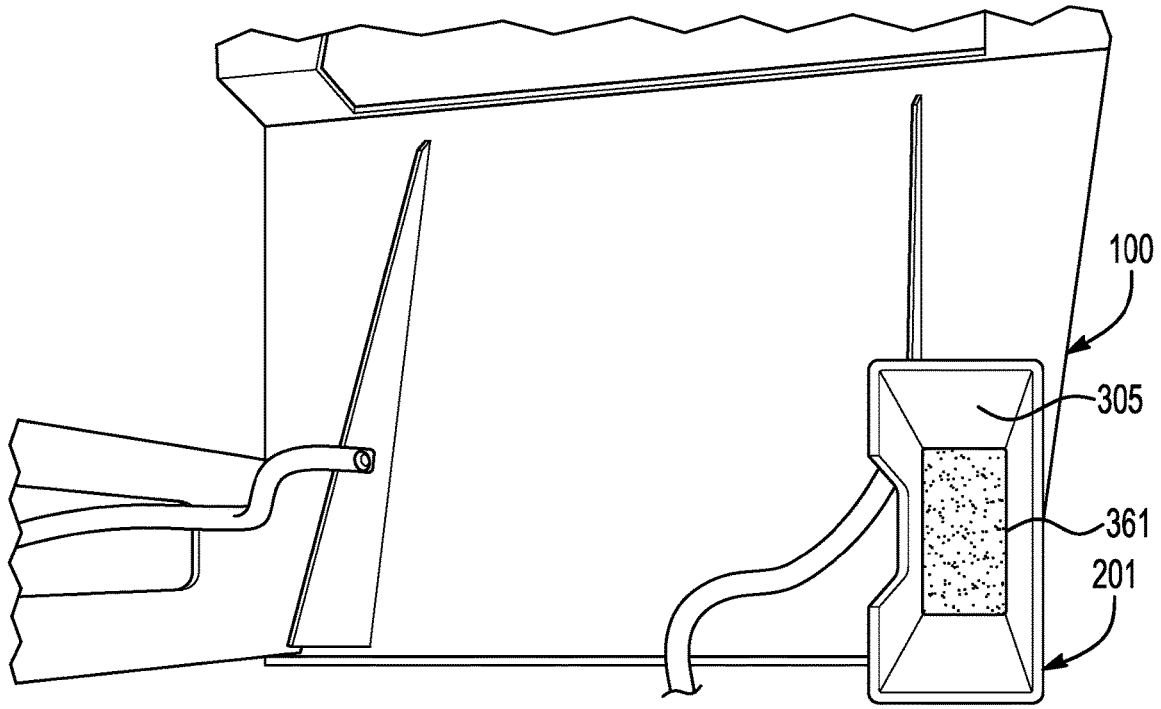
FIG. 13 is another enlarged bottom view of a portion of the ladder platform system of FIG. 5.
Figure 14:
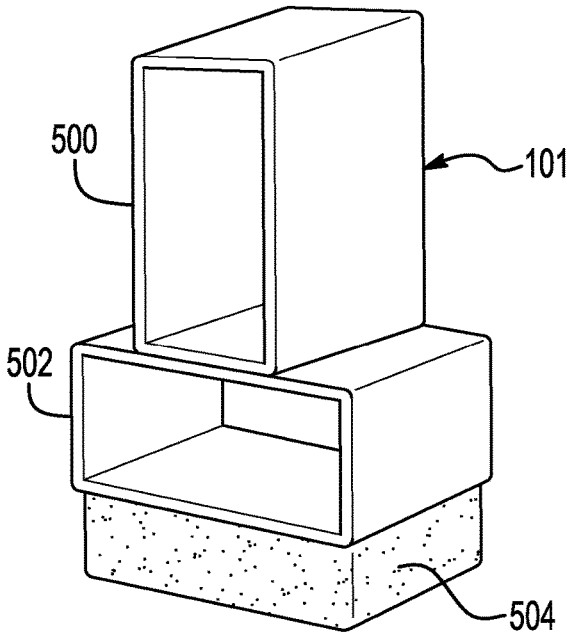
FIG. 14 is a schematic of a first standoff member utilized in the ladder platform system of FIG. 5.
Figure 15:
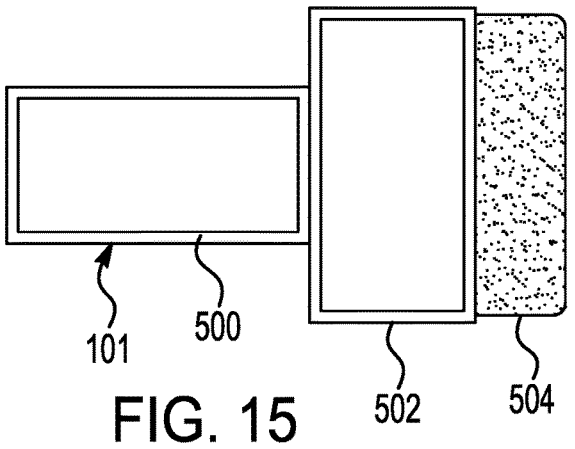
FIG. 15 is a side view of the first standoff member of FIG. 14.

Referring to FIGS. 6, 7, 12 and 13, the platform 204 includes a plate 350, first, second, third, fourth, and fifth tubular wall portions 351, 352, 353, 354, 355, and foam layers 361, 362 (shown in FIGS. 12 and 13, respectively). The plate 350 has a bottom surface 370 and a top surface 372. The bottom surface 370 is coupled to the first and second tubular legs 201, 202. The first, second, third, and fourth tubular wall portions 351, 352, 353, 354 are coupled to an outer peripheral portion 380 (shown in FIG. 6) of the top surface 372 of the plate 350 and define a primary storage area 400 on the top surface 372 for receiving work objects therein.

Referring to FIG. 6, the outer peripheral portion 380 of the top surface 372 of the plate 350 has first, second, third and fourth peripheral portions 391, 392, 393, 394. The first, second, third, and fourth tubular wall portions 351, 352, 353, 354 are disposed on the first, second, third and fourth peripheral portions 391, 392, 393, 394, respectively. The first tubular wall portion 351 is disposed proximate to the first and second tubular legs 201, 202. The second tubular wall portion 352 is disposed distal from the first tubular wall portion 351 and extends substantially perpendicular to the first tubular wall portion 351. The third and fourth tubular wall portions 353, 354, are disposed apart from one another and extend between the first and second tubular wall portions 351, 352. The fifth tubular wall portion 355 is disposed on the top surface 372 of the plate 350 that splits the primary storage area 400 into first and second storage areas 401, 402.

Figure 7:
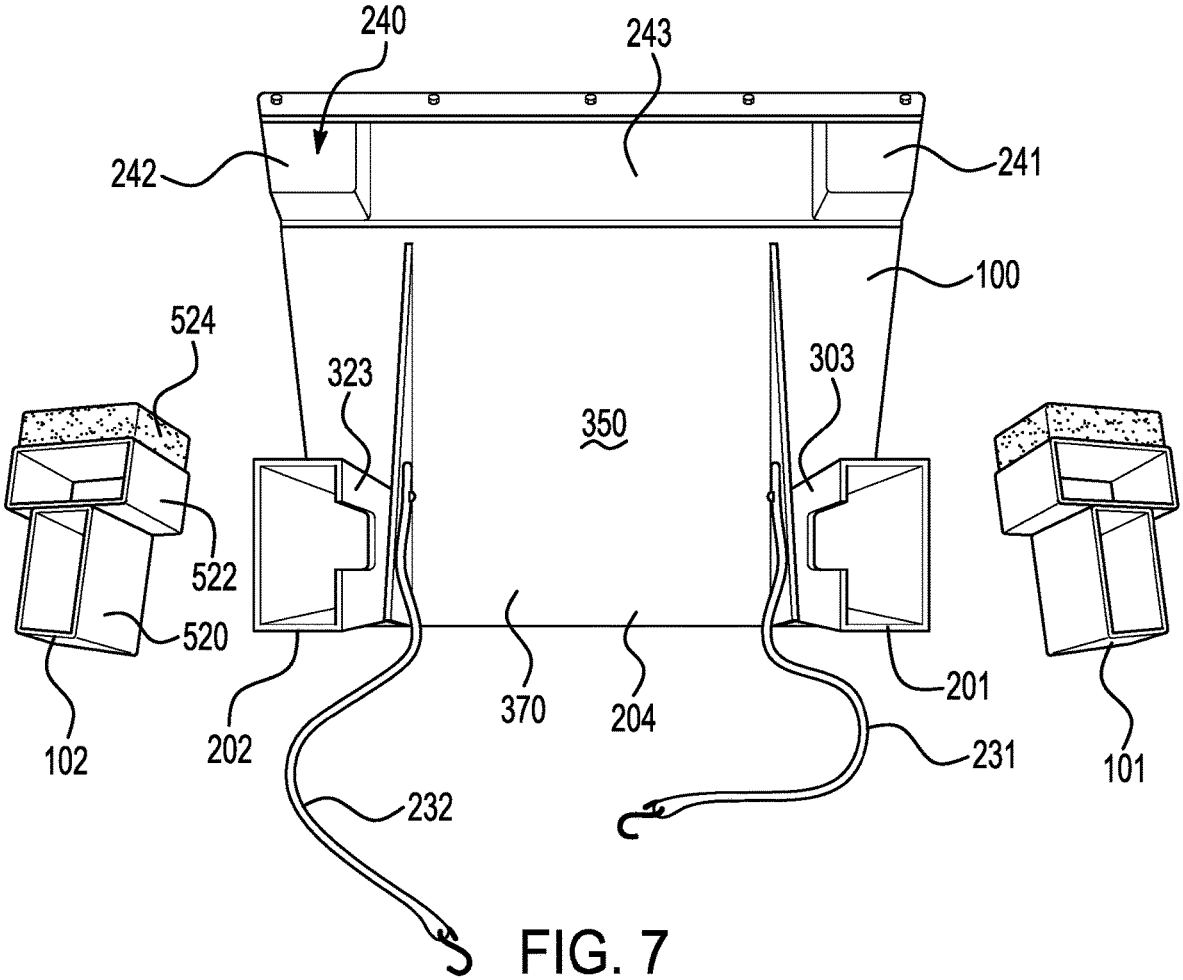
FIG. 7 is a bottom view of the ladder platform system of FIG. 5.

Referring to FIGS. 7 and 13, the foam layer 361 is disposed in an interior space 305 defined by the first tubular leg 201 and further against the bottom surface 370 of the plate 350.

Referring to FIGS. 7 and 12, the foam layer 362 is disposed in an interior space 325 defined by the second tubular leg 202 and further against the bottom surface 370 of the plate 350.

Figure 8:
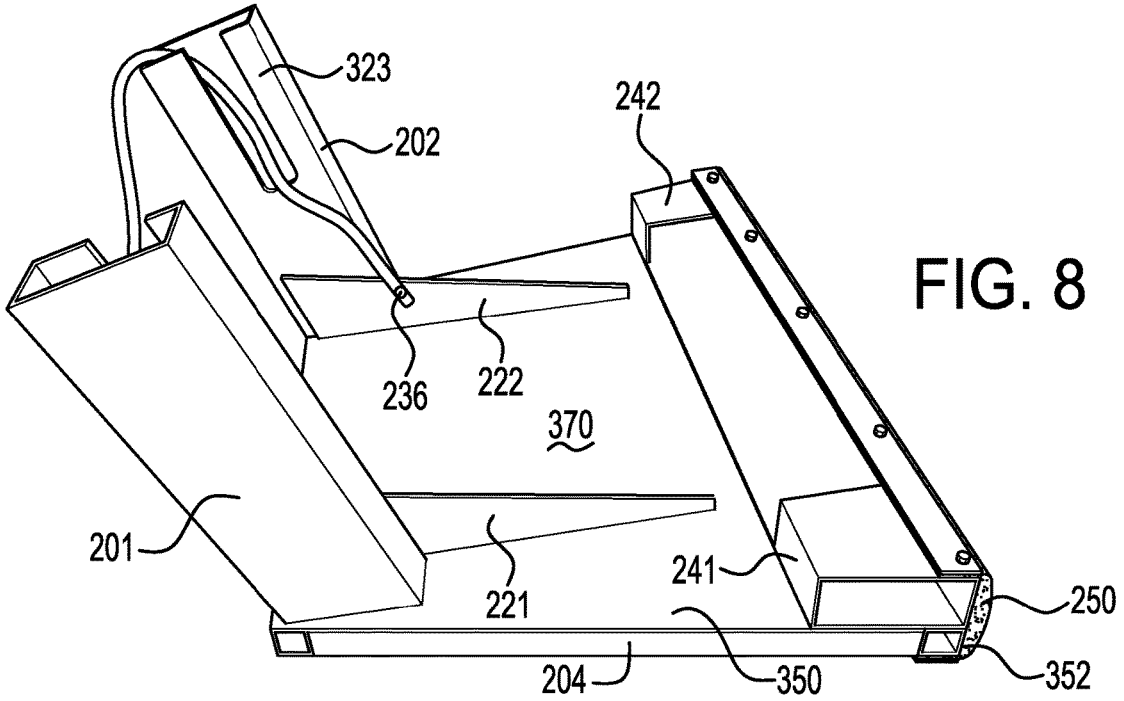
FIG. 8 is a side view of a ladder platform assembly utilized in the ladder platform system of FIG. 5.

Referring to FIGS. 8 and 11, the first support plate 221 is coupled to both the bottom surface 370 of the plate 350 and to the inner wall 303 of the first tubular leg 201. Further, the second support plate 222 is coupled to both the bottom surface 370 of the plate 350 and to the inner wall 323 of the second tubular leg 202.

Referring to FIGS. 7, 8, 10 and 11, the first strap member 231 is used to secure the ladder platform assembly 100 to the extension ladder 30. The first strap member 231 has an end that is coupled to the inner wall 303 of the first tubular leg 201 utilizing a screw 235 (shown in FIG. 11). Further, the second strap member 232 is used to secure the ladder platform assembly 100 to the extension ladder 30. The second strap member 232 has an end that is coupled to the inner wall 323 of the second tubular leg 202 utilizing a screw 236 (shown in FIG. 8).

Referring to FIGS. 1 and 7, the tubular board support sleeve 240 is coupled to the bottom surface 370 of the plate 350. The tubular board support sleeve 240 includes first and second tubular board support members 241, 242 and a plate portion 243 disposed therebetween. The first and second tubular board support members 241, 242 each have a rectangular-shaped cross-sectional profile and are spaced apart from another. The first and second tubular board support members 241, 242 are sized and shaped to receive a board 50 therethrough.

Figure 9:
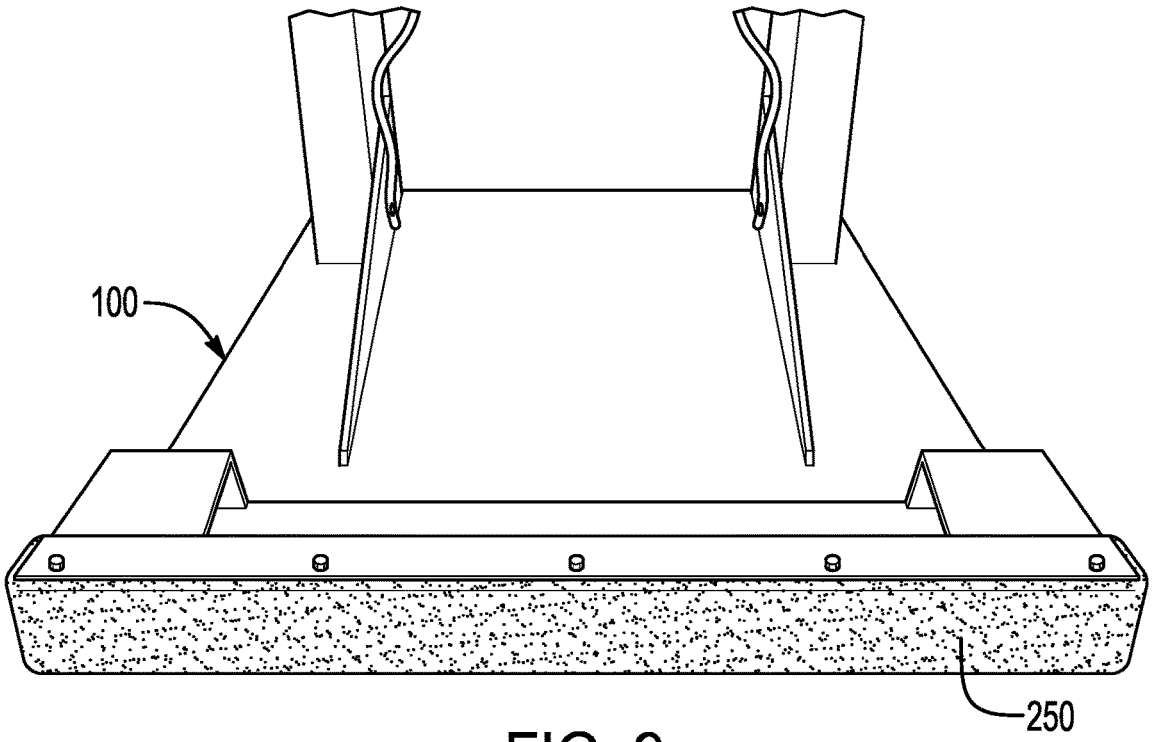
FIG. 9 is a front view of the ladder platform assembly of FIG. 8.

Referring to FIGS. 8 and 9, a bumper member 250 is coupled to the second tubular wall portion 352 and to the tubular board support sleeve 240.

Referring to FIGS. 1, 6, 14 and 15, the first standoff member 101 is sized and shaped to receive the board 50 therethrough. The first standoff member 101 includes a third tubular board support member 500, a frame member 502, and a foam layer 504. The third tubular board support member 500 has a rectangular-shaped cross-sectional profile and is sized and shaped to receive the board 50 therethrough. The third tubular board support member 500 is coupled to the frame member 502. The frame member 502 is further coupled to the foam layer 504.

Referring to FIGS. 1 and 7, the second standoff member 102 is sized and shaped to receive the board 50 therethrough. The second standoff member 102 includes a fourth tubular board support member 520, a frame member 522, and a foam layer 524. The fourth tubular board support member 520 has a rectangular-shaped cross-sectional profile and is sized and shaped to receive the board 50 therethrough. The fourth tubular board support member 520 is coupled to the frame member 522. The frame member 522 is further coupled to the foam layer 524.

The first and second standoff members 101, 102 are disposed on opposite sides of the ladder platform assembly 100, and the board 50 extends through the third tubular board support member 500 of the first standoff member 101, the first and second tubular board support members 241, 242 of the tubular board support sleeve 240 of the ladder platform assembly 100, and the fourth tubular board support member 520 of the second standoff member 102.

While the claimed invention has been described in detail in connection with only a limited number of embodiments, it should be readily understood that the invention is not limited to such disclosed embodiments. Rather, the claimed invention can be modified to incorporate any number of variations, alterations, substitutions or equivalent arrangements not heretofore described, but which are commensurate with the spirit and scope of the invention. Additionally, while various embodiments of the claimed invention have been described, it is to be understood that aspects of the invention may include only some of the described embodiments. Accordingly, the claimed invention is not to be seen as limited by the foregoing description.

What is claimed is:

1. A ladder platform assembly for attachment to an extension ladder, the extension ladder having first and second ladder side rails and a ladder step coupled to and extending between the first and second ladder side rails, the ladder platform assembly comprising:

a first tubular leg having a rectangular-shaped cross-sectional profile, first and second ends, and a first slot, the first slot extending through an inner wall of the first tubular leg and extending from the first end toward the second end thereof, the first tubular leg defining a first interior space between the first and second ends thereof that is sized and shaped to receive a top portion of the first ladder side rail therein; the first slot being sized and shaped to receive a portion of the ladder step therein;

a second tubular leg having a rectangular-shaped cross-sectional profile, first and second ends, and a second slot, the second slot extending through an inner wall of the second tubular leg and extending from the first end toward the second end thereof, the second tubular leg defining a second interior space between the first and second ends thereof that is sized and shaped to receive a top portion of the second ladder side rail therein; the second slot being sized and shaped to receive another portion of the ladder step therein; and a platform coupled to the second end of the first tubular leg and the second end of the second tubular leg such that the platform encloses the second end of the first tubular leg, and the platform further encloses the second end of the second tubular leg, the platform includes a plate and first, second, third, and fourth tubular wall portions; the plate having a bottom surface and a top surface, the bottom surface being coupled to the first and second tubular legs; the first, second, third, and fourth tubular wall portions being coupled to an outer peripheral portion of the top surface of the plate and define a primary storage area on the top surface for receiving work objects therein; the outer peripheral portion of the top surface of the plate having first, second, third and fourth peripheral portions; the first, second, third, and fourth tubular wall portions being disposed on the first, second, third and fourth peripheral portions, respectively; the first tubular wall portion being disposed proximate to the first and second tubular legs, the second tubular wall portion being disposed distal from the first tubular wall portion and extending substantially perpendicular to the first tubular wall portion, the third and fourth tubular wall portions being disposed apart from one another and extending between the first and second tubular wall portions; a fifth tubular wall portion being disposed on the top surface of the plate that splits the primary storage area into first and second storage areas.

2. The ladder platform assembly of claim 1, wherein the platform extending in a first direction from the first and second tubular legs.

3. The ladder platform assembly of claim 1, further comprising:

a first support plate coupled to both the bottom surface of the plate and to the inner wall of the first tubular leg; and a second support plate coupled to both the bottom surface of the plate and to the inner wall of the second tubular leg.

4. The ladder platform assembly of claim 3, further comprising:

a first strap member having an end that is coupled to the inner wall of the first tubular leg; and a second strap member having an end that is coupled to the inner wall of the second tubular leg.

5. The ladder platform assembly of claim 1, further comprising:

a tubular board support sleeve being coupled to the bottom surface of the plate, the tubular board support sleeve having first and second tubular board support members each having a rectangular-shaped cross-sectional profile, the first and second tubular board support members being spaced apart from another and being sized and shaped to receive a board therethrough.

6. The ladder platform assembly of claim 5, further comprising:

a bumper member coupled to the second tubular wall portion and to the tubular board support sleeve.

7. A ladder platform system for attachment to an extension ladder, the extension ladder having first and second ladder side rails and a ladder step coupled to and extending between the first and second ladder side rails, comprising:

a ladder platform assembly having a first tubular leg, a second tubular leg, a platform, and a tubular board support sleeve;

the first tubular leg having a rectangular-shaped cross-sectional profile, first and second ends, and a first slot, the first slot extending through an inner wall of the first tubular leg and extending from the first end toward the second end thereof, the first tubular leg defining a first interior space between the first and second ends thereof that is sized and shaped to receive a top portion of the first ladder side rail therein; the first slot being sized and shaped to receive a portion of the ladder step therein;

the second tubular leg having a rectangular-shaped cross-sectional profile, first and second ends, and a second slot, the second slot extending through an inner wall of the second tubular leg and extending from the first end toward the second end thereof, the second tubular leg defining a second interior space between the first and second ends thereof that is sized and shaped to receive a top portion of the second ladder side rail therein; the second slot being sized and shaped to receive another portion of the ladder step therein;

the platform coupled to the second end of the first tubular leg and the second end of the second tubular leg such that the platform encloses the second end of the first tubular leg, and the platform further encloses the second end of the second tubular leg; and the tubular board support sleeve being coupled to a bottom surface of the platform, the tubular board support sleeve being sized and shaped to receive a board therethrough;

a first standoff member being sized and shaped to receive the board therethrough; and a second standoff member being sized and shaped to receive the board therethrough.

8. The ladder platform system of claim 7, wherein:

the first standoff member includes a tubular board support member, a frame member, and a foam layer; and the tubular board support member having a rectangular-shaped cross-sectional profile and being sized and shaped to receive the board therethrough, the tubular board support member being coupled to the frame member, the frame member being further coupled to the foam layer.

9. The ladder platform system of claim 7, wherein:

the first and second standoff members are disposed on opposite sides of the ladder platform assembly.

10. The ladder platform system of claim 7, wherein the platform extending in a first direction from the first and second tubular legs.

11. The ladder platform system of claim 7, wherein:

the platform includes a plate and first, second, third, and fourth tubular wall portions;

the plate having a bottom surface and a top surface, the bottom surface being coupled to the first and second tubular legs; and the first, second, third, and fourth tubular wall portions being coupled to an outer peripheral portion of the top surface of the plate and define a primary storage area on the top surface for receiving work objects therein.

12. The ladder platform system of claim 11, wherein:

the outer peripheral portion of the top surface of the plate having first, second, third and fourth peripheral portions; the first, second, third, and fourth tubular wall portions being disposed on the first, second, third and fourth peripheral portions, respectively; the first tubular wall portion being disposed proximate to the first and second tubular legs, the second tubular wall portion being disposed distal from the first tubular wall portion and extending substantially perpendicular to the first tubular wall portion, the third and fourth tubular wall portions being disposed apart from one another and extending between the first and second tubular wall portions.

13. The ladder platform system of claim 12, further comprising:

a fifth tubular wall portion being disposed on the top surface of the plate that splits the primary storage area into first and second storage areas.

14. The ladder platform system of claim 12, further comprising:

a first support plate coupled to both the bottom surface of the plate and to the inner wall of the first tubular leg; and a second support plate coupled to both the bottom surface of the plate and to the inner wall of the second tubular leg.

15. The ladder platform system of claim 14, further comprising:

a first strap member having an end that is coupled to the inner wall of the first tubular leg; and a second strap member having an end that is coupled to the inner wall of the second tubular leg.

16. The ladder platform system of claim 12, further comprising:

a tubular board support sleeve being coupled to the bottom surface of the plate, the tubular board support sleeve having first and second tubular board support members each having a rectangular-shaped cross-sectional profile, the first and second tubular board support members being spaced apart from another and being sized and shaped to receive a board therethrough.

17. The ladder platform system of claim 16, further comprising:

a bumper member coupled to the second tubular wall portion and to the tubular board support sleeve.

18. A ladder platform assembly for attachment to an extension ladder, the extension ladder having first and second ladder side rails and a ladder step coupled to and extending between the first and second ladder side rails, the ladder platform assembly comprising:

a first tubular leg having a rectangular-shaped cross-sectional profile, first and second ends, and a first slot, the first slot extending through an inner wall of the first tubular leg and extending from the first end toward the second end thereof, the first tubular leg defining a first interior space between the first and second ends thereof that is sized and shaped to receive a top portion of the first ladder side rail therein; the first slot being sized and shaped to receive a portion of the ladder step therein;

a second tubular leg having a rectangular-shaped cross-sectional profile, first and second ends, and a second slot, the second slot extending through an inner wall of the second tubular leg and extending from the first end toward the second end thereof, the second tubular leg defining a second interior space between the first and second ends thereof that is sized and shaped to receive a top portion of the second ladder side rail therein; the second slot being sized and shaped to receive another portion of the ladder step therein; and a platform having a plate with a bottom surface coupled to the second end of the first tubular leg and the second end of the second tubular leg such that the plate encloses the second end of the first tubular leg, and the plate further encloses the second end of the second tubular leg;

first and second tubular board support members being coupled to the bottom surface of the plate and spaced apart from one another, each of the first and second tubular board support members having a rectangular-shaped cross-sectional profile sized and shaped to receive a board therethrough;

a bumper member coupled to the second tubular wall portion and to the first and second tubular board support members;

a first foam layer being disposed in the first interior space defined by the first tubular leg and further against the bottom surface of the plate; and a second foam layer being disposed in the second interior space defined by the second tubular leg and further against the bottom surface of the plate.

19. The ladder platform assembly of claim 18, further comprising:

a fifth tubular wall portion being disposed on a top surface of the plate that splits a primary storage area into first and second storage areas.

* * * * *